United States Patent [19]

Eriksson

[11] 4,247,148

[45] Jan. 27, 1981

[54] ASPHALT CUTTER

[76] Inventor: Tord E. B. Eriksson, Postlada 5284, S-761 00 Norrtälje, Sweden

[21] Appl. No.: 33,246

[22] Filed: Apr. 25, 1979

[30] Foreign Application Priority Data

May 8, 1978 [SE] Sweden ..... 7805233

[51] Int. Cl.[3] ..... E01C 23/09

[52] U.S. Cl. ..... 299/40; 30/292; 30/377

[58] Field of Search ..... 299/40; 172/561, 604, 172/777, 778, 15, 16; 175/307, 313, 373; 30/377, 292, 164.95

[56] References Cited

U.S. PATENT DOCUMENTS

| | | | |
|---|---|---|---|
| 1,780,174 | 11/1930 | Crowe | 30/377 |
| 1,813,231 | 7/1931 | Crowe | 30/377 |
| 3,067,989 | 12/1962 | Moench | 299/40 |
| 4,020,550 | 5/1977 | Okada | 30/292 |

*Primary Examiner*—Ernest R. Purser

*Attorney, Agent, or Firm*—Witherspoon & Hargest

[57] ABSTRACT

The present invention relates to an asphalt cutter including a fork to be attached to a working machine or the like. A cutting disc is rotatably supported on a shaft attached to and extending between the legs of the fork. A guiding device, preferably in the shape of a housing, at least in part enclosing the cutting disc is provided with a slot through which the cutting disc is projectable. The guiding device is continuously shiftable in the longitudinal direction of the fork between a position in which the cutting disc is substantially retracted into the slot and a position in which the cutting disc extends a predetermined amount outwardly from the slot.

3 Claims, 2 Drawing Figures

ASPHALT CUTTER

The present invention relates to asphalt cutters, particularly a type of asphalt cutter having a rotary cutting disc and intended to be used as an implement of excavators and similar working machines.

When for example cables and tubes are to led in asphalted streets and roads it is desirable that the intervention is kept at a minimum when the trenches are excavated. For this purpose several kinds of tools have been proposed enabling cuts to be made in the asphalt, such tools ranging from pneumatically driven hammardrills to specifically designed machines. The tube and cable trenches are normally excavated with the aid of excavators ranging in size from tractor excavators to huge machines. It is accordingly not economical to have specific machines for cutting the asphalt if the same result can be obtained at a lower cost by using a complementary tool on the excavator.

Certain such complementary tools of the type having a rotable cutting disc are previously known, the disc in these tools either being rotated with the aid of a driving device and thus operating as a cutting edge or being rotated by reciprocation in contact with the asphalt.

The present invention is concerned with asphalt cutters of the latter type. However, prior-art constuctions of this type have exhibited certain drawbacks. An essential difficulty in this connection consisted in preventing the cutting disc from becoming damaged under the heavy loads to which it is exposed during cutting of the asphalt. In order to facilitate cutting the cutting disc should be as thin as possible. However, prior-art asphalt cutters did not permit use of thin cutting discs and relatively thick discs had to be used. Cutting performance has been reduced thereby and the force required to cause the cutting disc to penetrate into and through the asphalt has become unnecessarily great.

It is the purpose of the present invention to eliminate the above mentioned problem as well as to provide other advantages not present in prior-art asphalt cutters. This purpose is achieved with the aid of the tool of the type indicated in the claims which also state the specific characteristic features of the novel construction.

Figure 1:
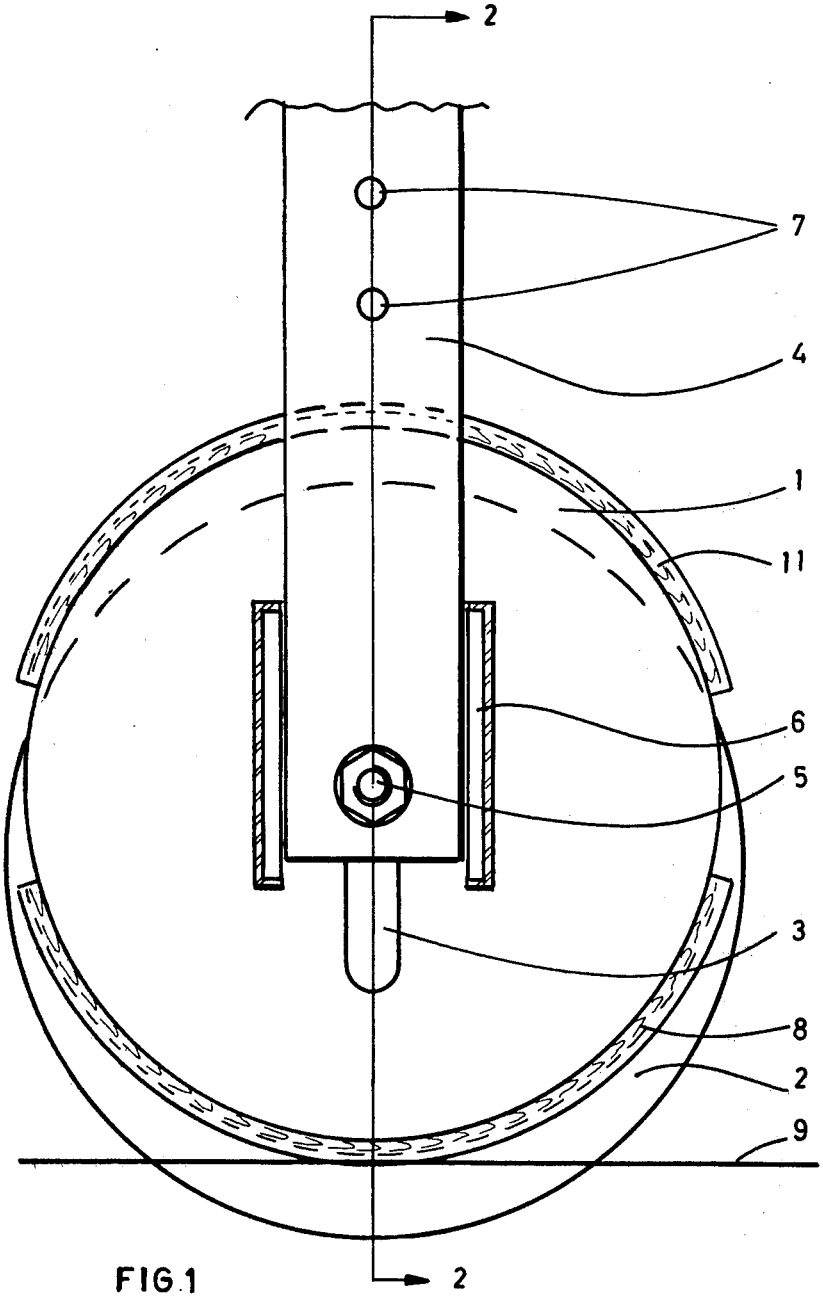
Figure 2:
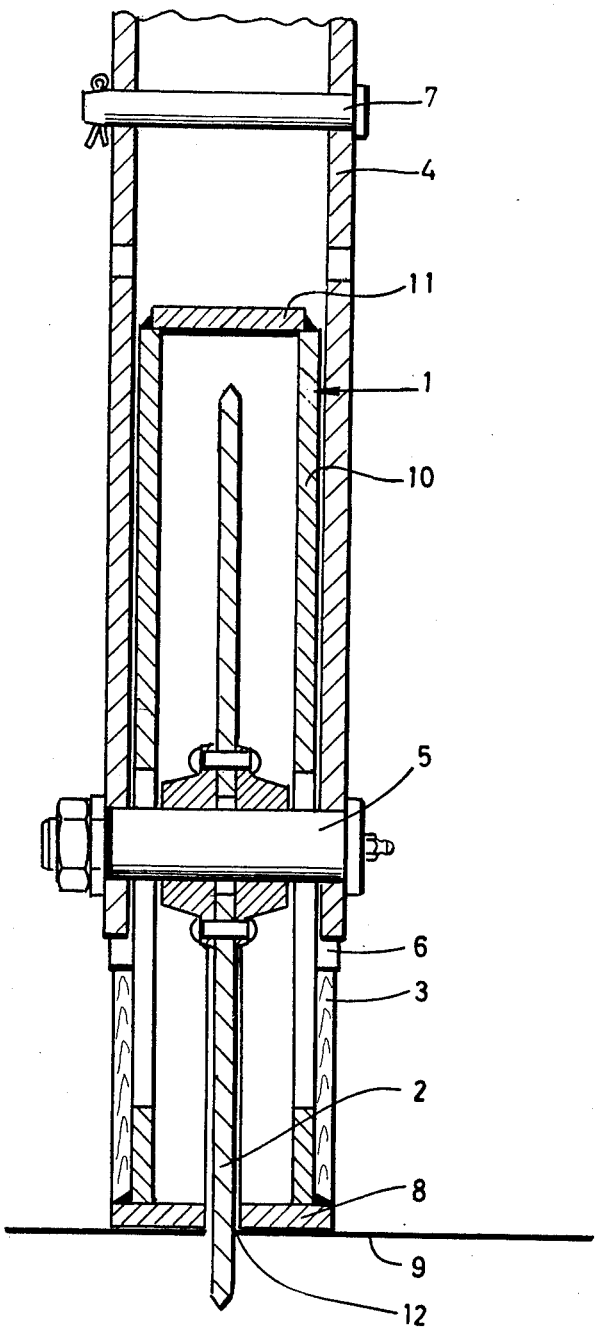

The invention is described in detail by reference to the attached drawings in which FIG. 1 is an elevation of the asphalt cutter according to the invention and FIG. 2 is a section taken along line 2—2 in FIG. 1.

The asphalt cutter according to the invention comprises a guide housing 1 for a cutting disc 2 and a fork 4 for the cutting disc 2, said fork supporting a shaft 5 carrying the cutting disc 2.

At its upper end fork 4 is provided with means not shown for attaching the unit to the tool holder of a working machine, the bucket of an excavator or the like. Shaft 5 rotatably carrying cutting disc 2 extends through the lower end of shaft 5. Cutting disc 2 is ground around its periphery to provide a cutting edge. When fork 4 is pressed towards the asphalt 9 and is reciprocated thereon cutting edge 2 will be in rolling contact with asphalt 9 to cut a notch therein. Due to steering difficulties of the machine and the varying conditions prevailing in the asphalt the cutting disc will be exposed to heavy stresses and breakage of the cutting disc occurs frequently in known constructions of this type. To a certain extent cutting disc breakage can be avoided by using a thick cutting disc but in this case greater force is required to urge the cutting disc into and through the asphalt.

To enable a thin cutting disc to be used without risk of breakage guiding house 1 is provided in accordance with the present invention. In the shown embodiment this guiding house 1 comprises two circular discs 10 mutually connected by an arcuate metal ribbon 11 extending around a part of the periphery of discs 10 at the upwardly facing portions thereof and which is attached by welding.

At the portion of the periphery of discs 10 facing the ground a ground support 8 in the form a metal ribbon is attached by welding in such a way that a slot opening 12 is formed through which cutting disc 2 extends.

The guiding house 1 has the same width as the distance between the legs of fork 4 and is disposed therebetween. An oblong aperture 3 in either disc 10 through which shaft 5 extends enables the guiding house 1 to be shifted in relation to fork 4 and cutting disc 2. In order to restrict this shifting movement of the guiding house 1 to the longitudinal direction of fork 4 guides 6 in the form of ridges are welded to the outer surface of the guiding house 1 on either side of either fork leg.

When the tool is in the starting position guiding house 1 completely encloses cutting disc 2. When the cutting process is to be performed fork 4 is pressed downwardly and is reciprocated over the asphalt. The guiding house 1 will then be in contact with asphalt 9 while cutting disc 2 is projected through slot opening 12 and penetrates into asphalt 9. The side-walls bounding slot opening 12 will guide cutting disc 2 closely adjacent the working place and cutting disc 2 thereby will be exposed only to extremely small bending forces thereby practically eliminating the risk of breakage.

Cutting disc 2 can be pressed down into the asphalt as far as openings 3 permit. If it is desired to reduce the permissable cutting depths this can be performed in the way as shown. A series of apertures in the fork 4 above the guiding house 1 are provided to receive a shiftable stop pin 7 limiting the shifting movement of guiding house 1 in fork 4 to the position where the stop pin contacts the guiding house.

An expert on the field will appreciate that the invention may be modified in respect to various requirements without deviation from the basic inventive idea as expressed in the attached claims. Obviously a tool in accordance with this invention may also be used for cutting material other than asphalt.

What I claim is:

1. An asphalt cutter comprising a fork, a shaft attached to and extending between the legs of said fork, a cutting disc rotatably supported on said shaft, and a guiding housing for enclosing said disc, said housing comprising a first side and a second side spaced from and attached to each other by a support member which extends about at least a portion of the periphery of said sides to provide a chamber in which said disc is housed, said support member including a slot through which a portion of said disc may extend during the cutting operation, each of said sides including an elongated opening through which said shaft extends such that said housing is continuously shiftable relative to said shaft and said disc in a longitudinal direction relative to said fork between a first position in which said disc is substantially retracted through said slot into said chamber and a second position in which a portion of said disc is projected outwardly from said chamber and through said slot during the cutting operation. --

2. An asphalt cutter comrising a fork, a shaft attached to and extending between the legs of said fork, a cutting disc rotatably supported on said shaft, and a guiding housing for enclosing said disc, said housing comprising two mutually parallel discs held in mutually spaced relationship by means of an arcuate distance element which extends around a part of the periphery of said parallel discs and is attached thereto to provide a chamber in which said disc is housed, a ground support element which extends around and is attached to a part of the periphery of said parallel discs at the end of said guiding housing opposite said arcuate distance element, said ground support element including a slot through which a portion of said disc may extend during the cutting operation, each of said parallel discs having an oblong aperture through which said shaft extends such that said housing is continuously shiftable relative to said shaft and said disc in a longtitudinal direction relative to said fork between a first position in which said disc is substantially retracted through said slot into said chamber and a second position in which a portion of said disc is projected outwardly from said chamber and through said slot during the cutting operation, and guide elements attached to the outwardly facing sides of said parallel discs to cooperate with said fork legs to prevent the guiding housing from rotating.

3. An asphalt cutter as claimed in Claim 1 or 2 wherein said fork legs include apertures into at least one of which a pin is inserted to selectively limit the shifting movement of said guiding housing.

* * * * *